US011435085B2

(12) United States Patent
Bucks et al.

(10) Patent No.: US 11,435,085 B2
(45) Date of Patent: Sep. 6, 2022

(54) PIVOTING DISPLAY FOR APPLIANCE

(71) Applicants: BSH Home Appliances Corporation, Irvine, CA (US); BSH Hausgeräte GmbH, Munich (DE)

(72) Inventors: Andre Bucks, Lakeland, TN (US); Charles Hanna, Knoxville, TN (US); Tanner Justice, Powell, TN (US); Ian McIver, Knoxville, TN (US)

(73) Assignees: BSH Home Appliances Corporation, Irvine, CA (US); BSH Hausgeraäte GmbH, Munich (DE)

( * ) Notice: Subject to any disclaimer, the term of this patent is extended or adjusted under 35 U.S.C. 154(b) by 13 days.

(21) Appl. No.: 16/950,952

(22) Filed: Nov. 18, 2020

(65) Prior Publication Data

US 2022/0154938 A1 May 19, 2022

(51) Int. Cl.
*F24C 3/12* (2006.01)

(52) U.S. Cl.
CPC ..... *F24C 3/124* (2013.01); *F24C 3/126* (2013.01)

(58) Field of Classification Search
CPC ..... F24C 3/124; F24C 3/126; F24C 7/082; F24C 3/086; F24D 2400/361
USPC ..... 126/273 R
See application file for complete search history.

(56) References Cited

U.S. PATENT DOCUMENTS

| | | | | |
|---|---|---|---|---|
| 4,758,923 | A * | 7/1988 | Tanaka | B29C 45/1774 361/627 |
| 7,031,144 | B2 | 4/2006 | Carter et al. | |
| 9,863,642 | B2 | 1/2018 | Je et al. | |
| 2013/0093967 | A1* | 4/2013 | Osborne | B60R 11/0235 348/837 |
| 2018/0187897 | A1* | 7/2018 | Kim | F24C 7/085 |

FOREIGN PATENT DOCUMENTS

| | | | |
|---|---|---|---|
| DE | 3520272 | A1 | 12/1986 |
| DE | 3621260 | A1 | 1/1988 |
| DE | 102007033347 | A1 | 8/2008 |
| DE | 102010001586 | A1 | 8/2011 |
| EP | 1795642 | B1 | 6/2007 |
| EP | 2172143 | B1 | 12/2016 |

* cited by examiner

*Primary Examiner* — Vivek K Shirsat
(74) *Attorney, Agent, or Firm* — Michael E. Tschupp; Andre Pallapies; Brandon G. Braun

(57) ABSTRACT

A control panel for a domestic appliance has a main body having a front surface; controls attached to the main body that provide instructions to devices of the domestic appliance; and a display unit located in the main body. The display unit has a stationary portion attached to the main body, a pivoting portion pivotably attached to the stationary portion, the pivoting portion having a closed position and an open position. The pivoting portion has a front surface and a display that displays information to a user of the appliance. The display unit also has a pivoting mechanism that attaches the pivoting portion to the stationary portion, a mechanical urging member that urges the pivoting portion in a direction from the closed position to the open position, and a holding mechanism that retains the pivoting portion in the closed position.

20 Claims, 8 Drawing Sheets

PIVOTING DISPLAY FOR APPLIANCE

FIELD OF THE INVENTION

The invention is directed to a domestic appliance. More particularly, embodiments of the invention are directed to a cooking appliance having a pivoting display panel.

An example of an application for the invention is a domestic kitchen oven having a display and/or control panel that moves between a retracted position and an extended position by pivoting around a pivot point.

BACKGROUND OF THE INVENTION

Some modern domestic kitchens include cooking appliances such as ovens and ranges that have a display panel that displays information regarding the operation of the appliance. In some cases, the display panels show cooking temperatures, actual temperatures, oven and/or cooktop settings, timers, burner/heating element status, and/or other parameters related to the appliance. In some cases, the display panels include controls such as, for example, timer settings, temperature settings, heating element settings, and/or other controls related to the appliance.

Applicants recognized an improvement to the above arrangement and implement that improvement in embodiments of the invention.

SUMMARY

The invention achieves the benefit of providing a more easily readable display that moves quietly and smoothly from a closed position to an open position.

Some cooking appliances have displays that show various information regarding the operation of the appliance. Embodiments of the invention improve the user experience by making the display more easily readable and providing a smooth and quiet transition from the closed position to the open position.

Particular embodiments of the invention are directed to a domestic cooking appliance for heating a food item. The domestic cooking appliance includes a main housing; a heating device that provides heat for heating the food item; a control panel having controls that provide instructions to the heating device, the control panel having a front surface; and a display unit located in the control panel. The display unit has a stationary portion attached to the control panel, a pivoting portion pivotably attached to the stationary portion. The pivoting portion has a closed position and an open position. The pivoting portion has a front surface and a display that displays information to a user of the appliance, the front surface of the pivoting portion and the display being visible from an outside of the appliance in both the open position and the closed position. The display unit also has a pivoting mechanism located at an upper end of the pivoting portion and that attaches the pivoting portion to the stationary portion such that the pivoting portion pivots relative to the stationary portion about the pivoting mechanism, a mechanical urging member that urges the pivoting portion in a direction from the closed position to the open position, and a holding mechanism that retains the pivoting portion in the closed position. The front surface of the pivoting portion is in a plane parallel to the front surface of the control panel when the pivoting portion is in the closed position, and a lower end of the front surface of the pivoting portion is positioned away from the front surface of the control panel when the pivoting portion is in the open.

Other embodiments of the invention are directed to a control panel for a domestic appliance. The control panel has a main body having a front surface; controls attached to the main body that provide instructions to devices of the domestic appliance; and a display unit located in the main body. The display unit has a stationary portion attached to the main body, a pivoting portion pivotably attached to the stationary portion, the pivoting portion having a closed position and an open position. The pivoting portion has a front surface and a display that displays information to a user of the appliance, the front surface of the pivoting portion and the display being visible from an outside of the control panel in both the open position and the closed position. The display unit also has a pivoting mechanism located at an upper end of the pivoting portion and that attaches the pivoting portion to the stationary portion such that the pivoting portion pivots relative to the stationary portion about the pivoting mechanism, a mechanical urging member that urges the pivoting portion in a direction from the closed position to the open position, and a holding mechanism that retains the pivoting portion in the closed position. The front surface of the pivoting portion is in a plane parallel to the front surface of the main body when the pivoting portion is in the closed position, and a lower end of the front surface of the pivoting portion is positioned away from the front surface of the main body when the pivoting portion is in the open position.

BRIEF DESCRIPTION OF THE DRAWINGS

The following figures form part of the present specification and are included to further demonstrate certain aspects of the disclosed features and functions, and should not be used to limit or define the disclosed features and functions. Consequently, a more complete understanding of the exemplary embodiments and further features and advantages thereof may be acquired by referring to the following description taken in conjunction with the accompanying drawings, wherein.

DETAILED DESCRIPTION

The invention is described herein with reference to the accompanying drawings in which exemplary embodiments of the invention are shown. The invention may, however, be embodied in many different forms and should not be construed as limited to the embodiments set forth herein.

As explained above, embodiments of the invention provide an improvement to a domestic oven or other appliance.

Figure 1:
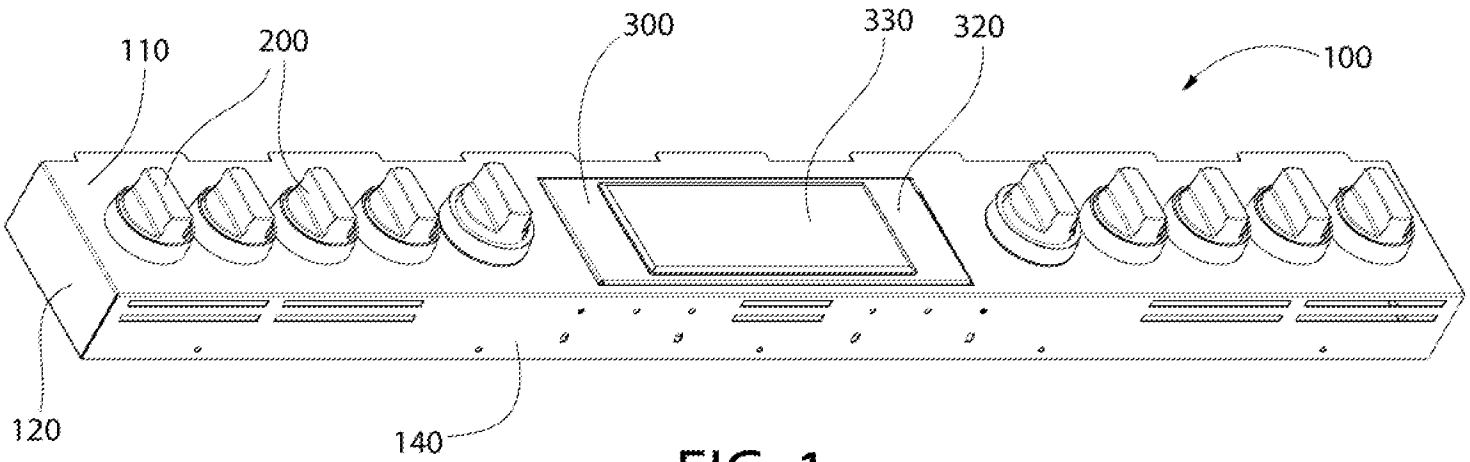
FIG. 1 is a lower front perspective view of an exemplary appliance panel with the display in a closed position in accordance with embodiments of the invention.

FIG. 1 is a front perspective view of an example of a domestic cooking appliance control panel in accordance with embodiments of the invention. Control panel 100 has a front face 110, a top edge 150, a bottom side 140, a left side 120 and a right side 130. Also shown in this example are ten control knobs 200. Control knobs 200 provide a user with a manner in which to control appliance functions such as, for example, burner gas flow, oven temperature, electric heating element heat level, etc. While this example has ten control knobs 200, other examples have fewer or more control knobs 200. Also shown in FIG. 1 is a display unit 300 centrally located in front face 110 of control panel 100. Display unit 300 has a front surface 320 and a display 330 located centrally in front surface 320. While in this example, display unit 300 is centrally located in front face 110 of control panel 100, in other examples, display unit 300 is located in other positions in front face 110. Display 330 is, in this example, a touch sensitive screen that displays information regarding the appliance. Examples of information displayed on display 330 include current time, oven temperature settings, actual oven temperatures, various timers, burner status and/or level, etc. Display unit 300 moves between a closed position (shown in FIGS. 1-8) and an open position (shown in FIGS. 9-17). Display 330 operates in both the closed and open positions such that the information shown on display 330 is shown in both the closed and open positions, and the controls operable through display 330 are operable in both the closed and open positions. By providing viewing and operation control in both the closed and open positions, display unit 300 provides a user more convenient and comfortable viewing and operation. For example, with display unit 300 in the open position, a user can view and operate display 330 from a standing position close to the front of the appliance. In some situations, a user may have to bend down to view and operate display 330 in the closed position. Also, control panel 100 has a flat and clean appearance with display unit 300 in the closed position.

Figure 2:
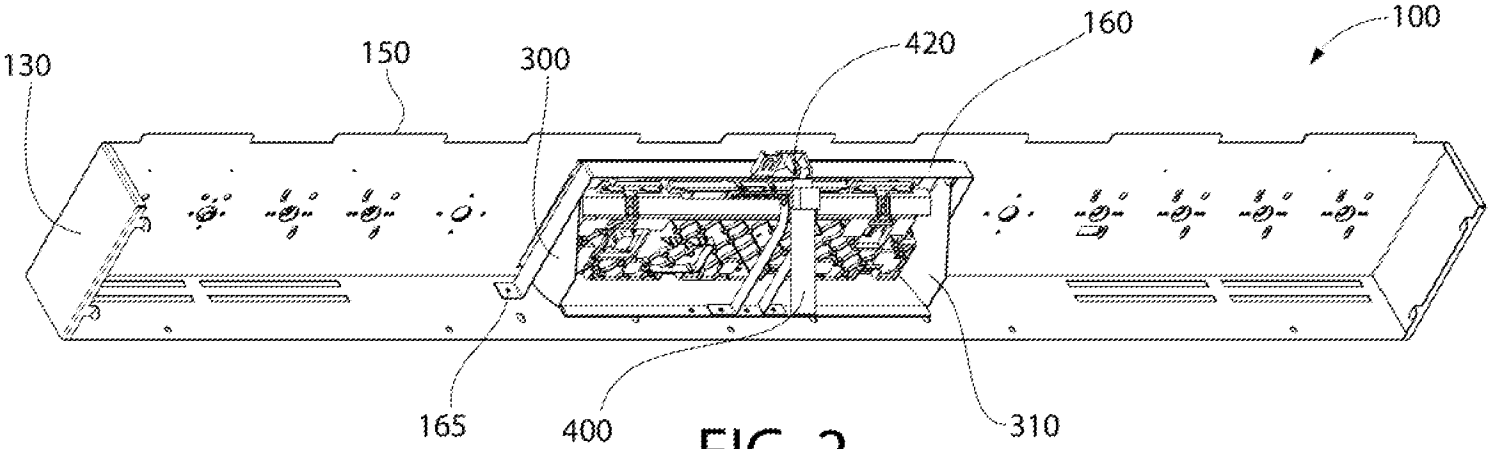
FIG. 2 is an upper rear perspective view of the appliance panel shown in FIG. 1 with the display in a closed position.

FIG. 2 is a rear perspective view of control panel 100. In this example, display unit 300 is held in place in control panel 100 by a strap 160. In this example, strap 160 is attached to control panel 100 at two attachment points 165. In embodiments, strap 160 is attached to control panel 100 with screws, rivets, or some other type of fastener. Display unit 300 has a pivoting portion 310 that pivots relative to a stationary portion of display unit 300 and, therefore, relative to control panel 100. Show in FIG. 2 is a mechanical urging mechanism 400 (discussed in more detail below) that provides an opening force to pivoting portion 310 that urges pivoting portion 310 from the closed position (shown in FIGS. 1-8) to the open position (shown in FIGS. 9-17).

Figure 3:
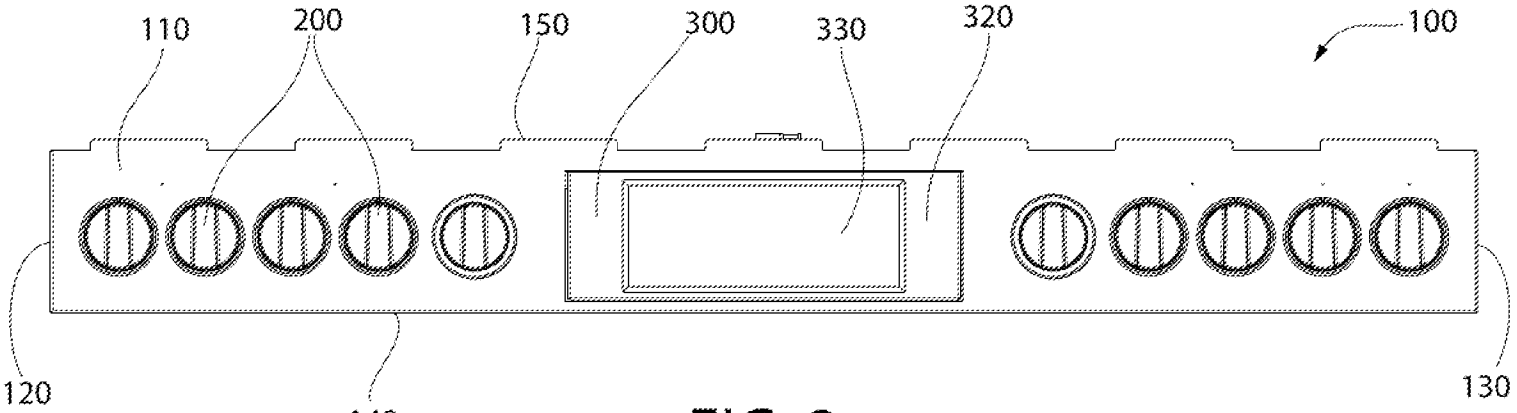
FIG. 3 is a front view of the appliance panel shown in FIG. 1 with the display in a closed position.
Figure 4:
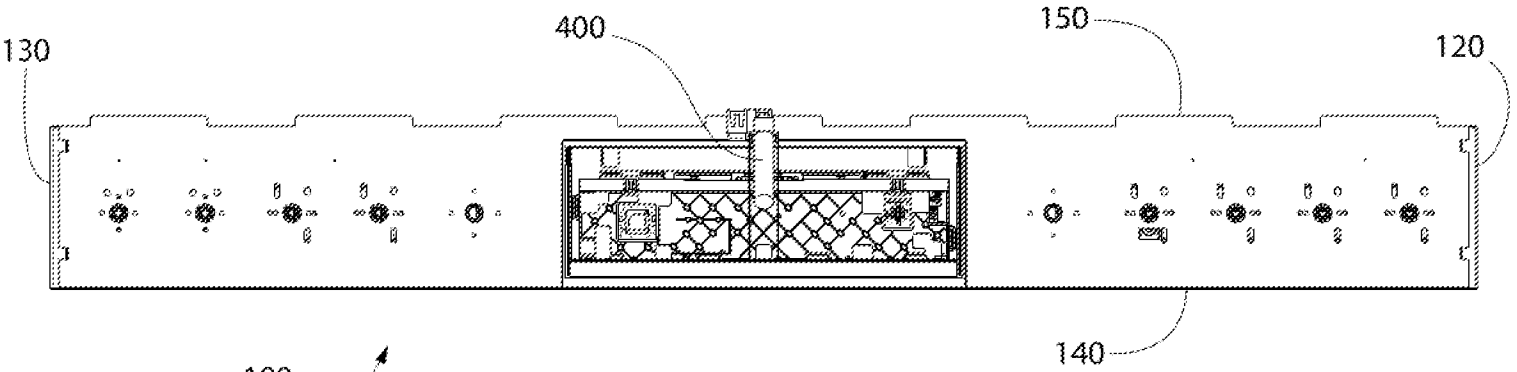
FIG. 4 is a rear view of the appliance panel shown in FIG. 1 with the display in a closed position.

FIG. 3 is a front view of control panel 100. In this example, top edge 150 includes a plurality of tabs that are inserted into a plurality of slots in a main body of the appliance. In other examples, the plurality of tabs interact in some other way with the main body of the appliance. FIG. 4 is a rear view of control panel 100 showing the position of mechanical urging mechanism 400 in the closed position of display unit 300.

Figure 5:
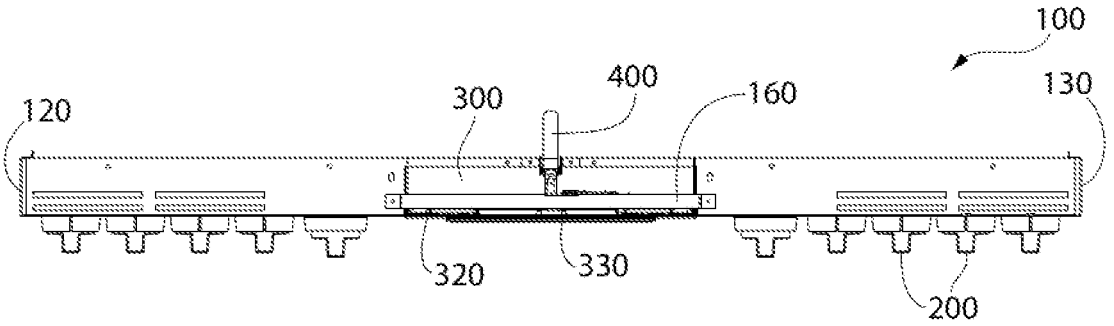
FIG. 5 is top view of the appliance panel shown in FIG. 1 with the display in a closed position.
Figure 6:
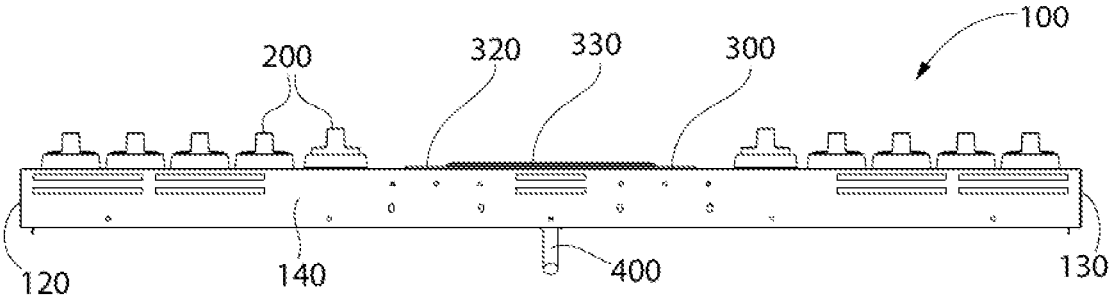
FIG. 6 is bottom view of the appliance panel shown in FIG. 1 with the display in a closed position.
Figure 7:
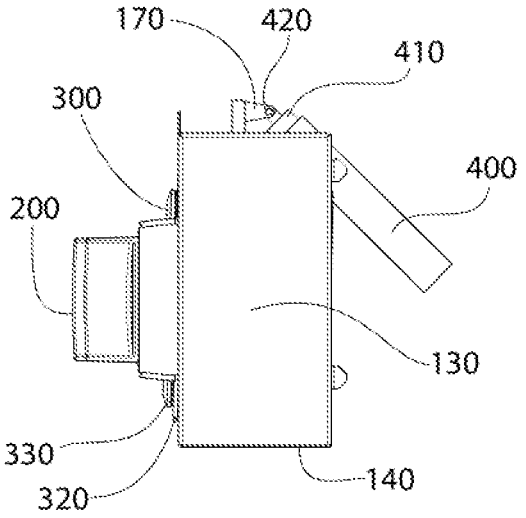
FIG. 7 is a right side view of the appliance panel shown in FIG. 1 with the display in a closed position.
Figure 8:
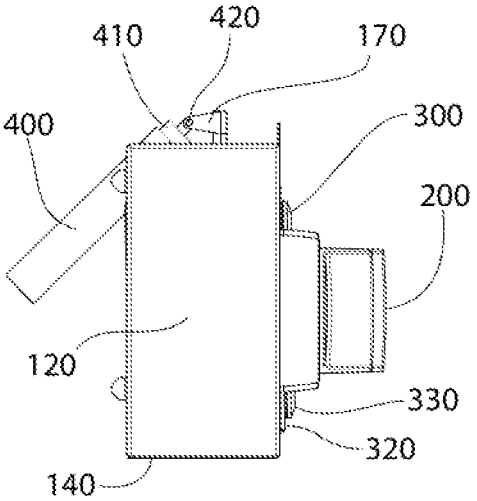
FIG. 8 is a left side view of the appliance panel shown in FIG. 1 with the display in a closed position.

FIG. 5 is a top view of control panel 100 showing display unit 300 held in place by strap 160 with display unit 300 in the closed position. FIG. 6 is a bottom view of control panel 100 with display unit 300 in the closed position. FIG. 7 is a right side view of control panel 100 in the closed position. FIG. 8 is a left side view of control panel 100 in the closed position. FIGS. 7 and 8 show that, in this example, display 330 protrudes slightly from front face 320 of display unit 300, and front face 320 of display unit 300 protrudes slightly from front face 110 of control panel 100. In other examples, front face 320 of display unit 300 is flush with front face 110 of control panel 100 when display unit 300 is in the closed position. In some examples, display 330 is flush with front face 320 of display unit 300 and front face 110 of control panel 100 when display unit 300 is in the closed position.

Figure 9:
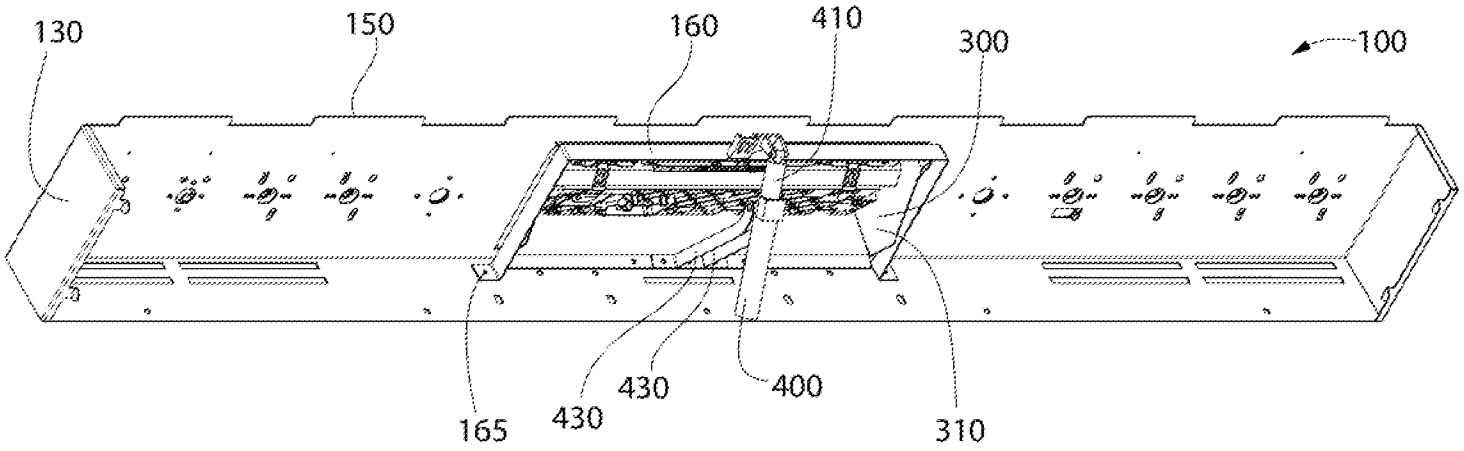
FIG. 9 is an upper rear perspective view of the appliance panel shown in FIG. 1 with the display in an open position.

FIG. 9 is a rear perspective view of control panel 100 in the open position. As shown in FIG. 9, when display unit 300 is in the open position, pivoting portion 310 of display unit 300 pivots relative to a stationary portion of display unit 300 (represented by strap 160) and, therefore, front face 110 of control panel 100.

Figure 10:
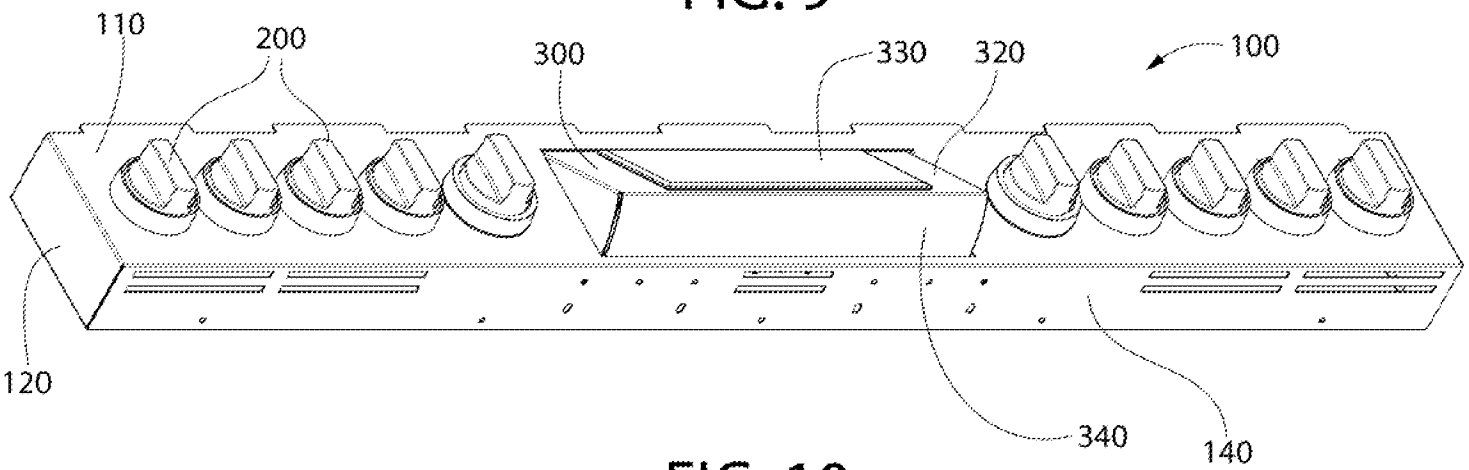
FIG. 10 is a lower front perspective view of the appliance panel shown in FIG. 1 with the display in an open position.

FIG. 10 is a front perspective view of control panel 100 with display unit 300 in the open position. In this example, display unit 300 has a curved bottom surface 340 that is exposed when display unit 300 is in the open position. As can be seen from FIG. 10, when display unit 300 is in the open position, front face 320 and display 330 are at an angle relative to front face 110 of control panel 100. In some embodiments, display unit 300 pivots a set amount from the closed position to the open position. In some embodiments, display unit 300 has a plurality of open positions, each of which having a different amount of pivot.

Figure 12:
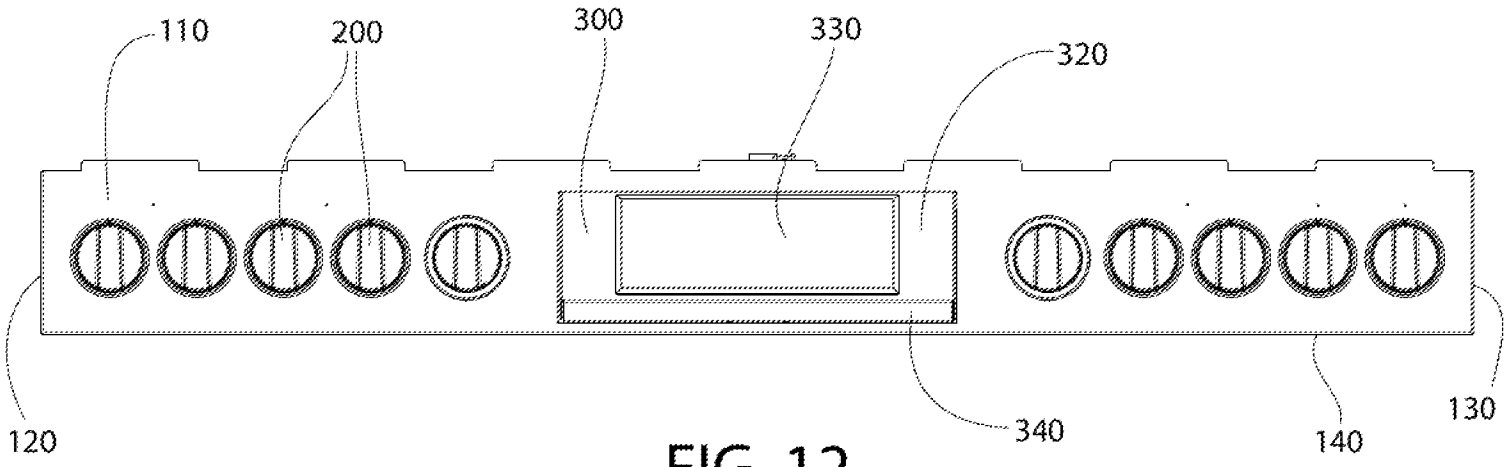
FIG. 12 is a front view of the appliance panel shown in FIG. 1 with the display in an open position.
Figure 13:
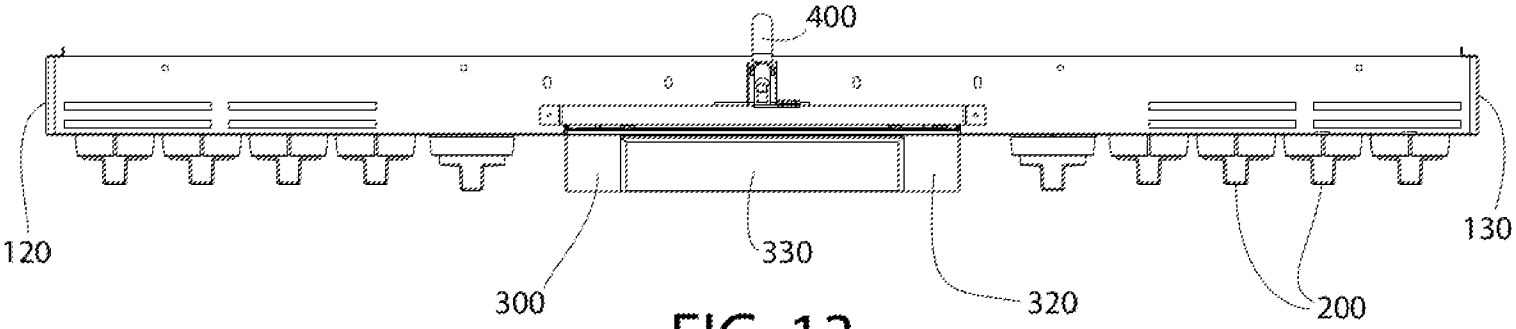
FIG. 13 is a top view of the appliance panel shown in FIG. 1 with the display in an open position.

FIG. 12 is a front view of control panel 100 with display unit 300 in the open position. In this view, bottom surface 340 of display unit 300 is visible. FIG. 13 is a top view of control panel 100 with display unit 300 in the open position and shows the position of mechanical urging mechanism 400 in the open position of display unit 300.

Figure 16:
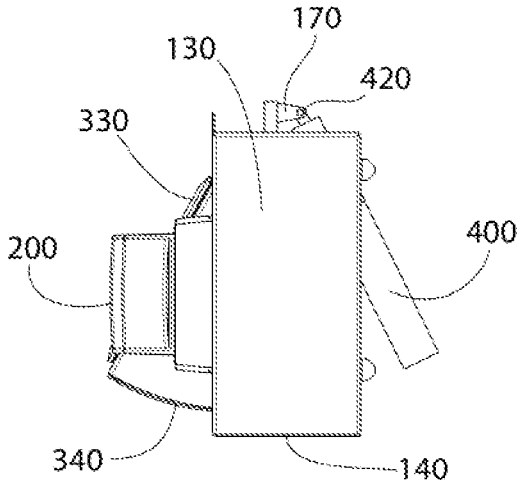
FIG. 16 is a right side view of the appliance panel shown in FIG. 1 with the display in an open position.
Figure 17:
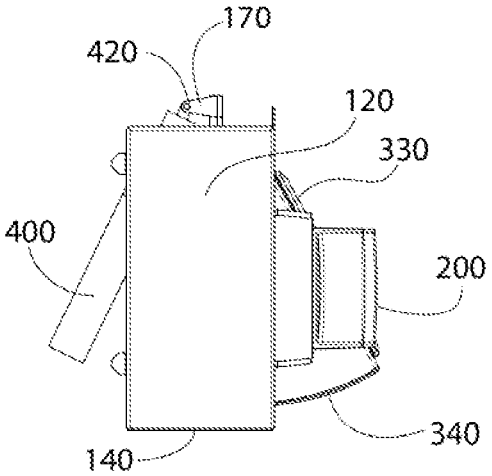
FIG. 17 is a left side view of the appliance panel shown in FIG. 1 with the display in an open position.
Figure 14:
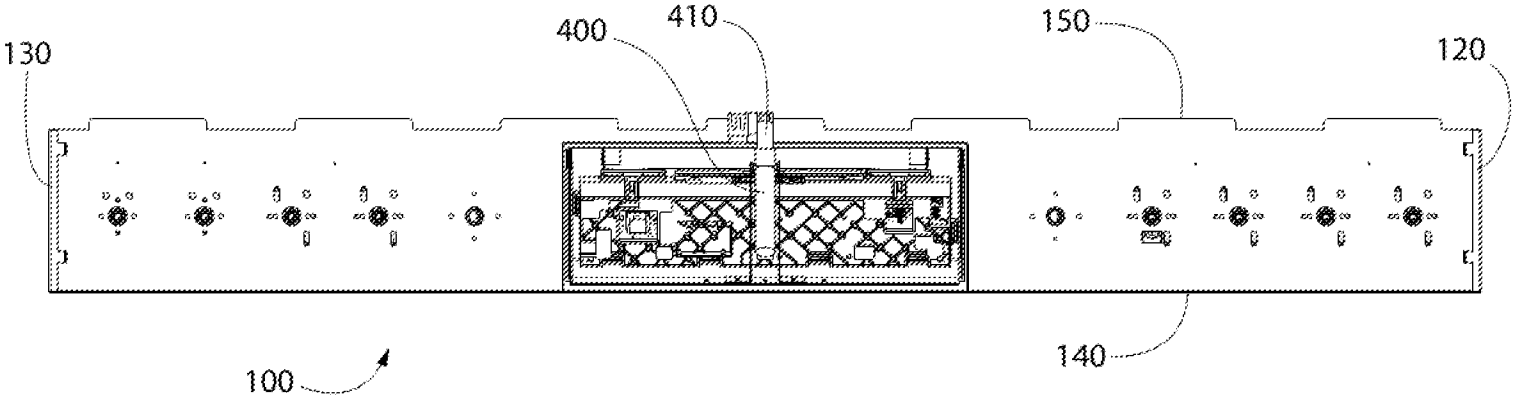
FIG. 14 is a rear view of the appliance panel shown in FIG. 1 with the display in an open position.
Figure 15:
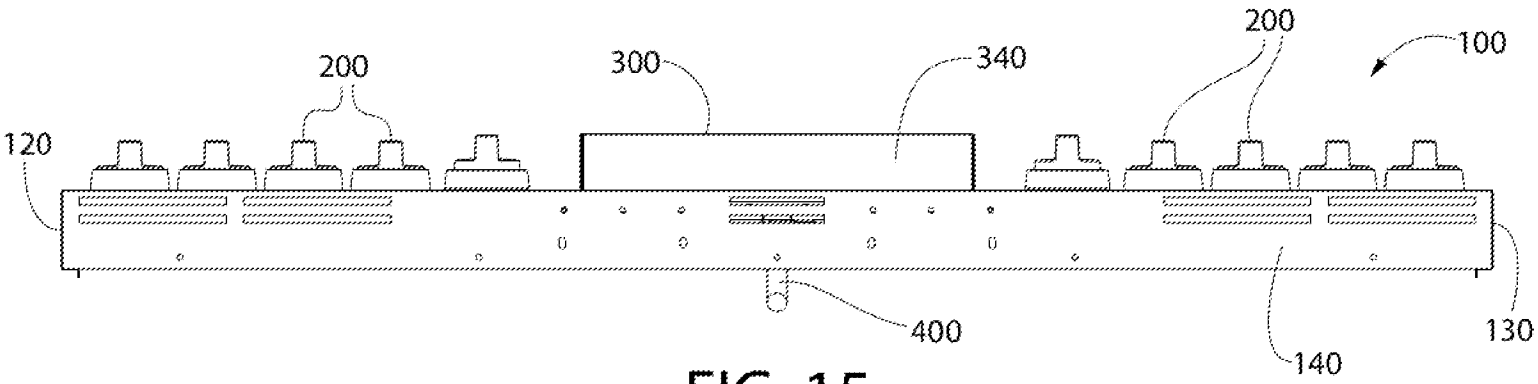
FIG. 15 is a bottom view of the appliance panel shown in FIG. 1 with the display in an open position.

FIG. 14 is a rear view of control panel 100 with display unit 300 in the open position. FIG. 15 is a bottom view of control unit 100 with display unit 300 in the open position. FIG. 16 is a right side view of control panel 100 with display unit 300 in the open position. FIG. 17 is a left side view of control panel 100 with display unit 300 in the open position.

Figure 11:
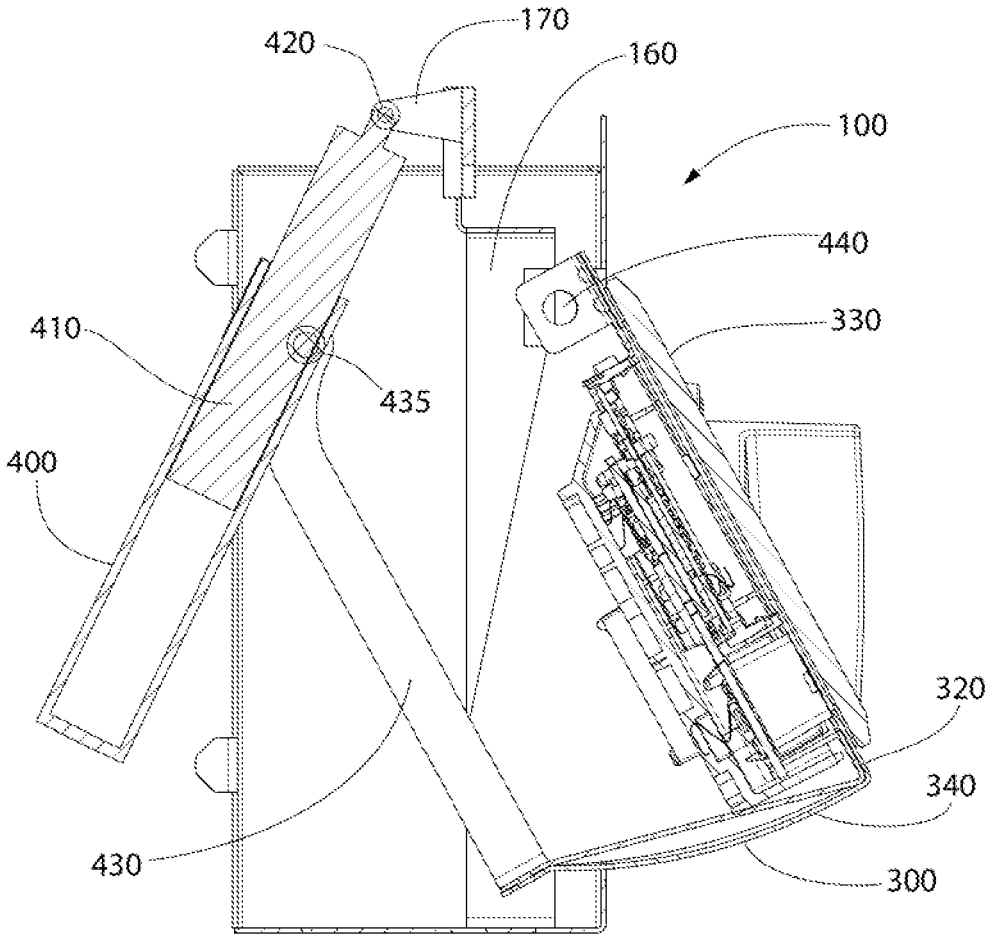
FIG. 11 is a sectional view of view of the appliance panel shown in FIG. 1 with the display in an open position.

FIG. 11 shows a section of control unit 100 with display unit 300 in the open position. The pivoting portion of display unit 300, which includes front face 320, display 330, and bottom surface 340, pivots relative to the stationary portion of display unit 300, which include strap 160 and an upper bracket 170 that includes an urging mechanism pivot point 420. The pivoting portion of display unit 300 pivots around a pivot point 440. In some examples, pivot point 440 is a pin or other joint that allows pivoting motion. In some examples, urging mechanism pivot point 420 is a pin or other joint that allows pivoting motion.

FIG. 11 shows mechanical urging mechanism 400 having a piston 410 that moves within a cylinder. In embodiments, the cylinder contains a gas that is compressed by piston 410 when display unit 300 is in the closed position. In other embodiments, the cylinder contains a spring that is compressed when display unit 300 is in the closed position. In this example, two arms 430 are fixed to display unit 300 at one end such that they are fixed relative to display 330. The other end of arms 430 are attached to the cylinder at a pivot point 435. As display unit 300 moves from the open position to the closed position, pivot point 435 is pushed upward by arms 430, which push the cylinder to a more compressed position relative to piston 410 because the upper end of piston 420 is retained by upper pivot point 420. The compression of the gas (or spring) provides an urging force that pushes display unit 300 toward the open position.

A catch mechanism (not shown) is provided to retain display unit 300 in the closed position against the urging force of mechanical urging mechanism 400. In embodiments, the catch mechanism has a first portion attached to the stationary portion of display unit 300 and a second portion attached to pivoting portion 310 of display unit 300. When pivoting portion 310 of display unit 300 is in the closed position, the first and second portions of the catch mechanism engage each other and hold pivoting portion 310 in the closed position. In embodiments, when a user applies a pushing force to display 330 and/or front surface 320 inward from the closed position, the catch mechanism is released such that when the user removes the pushing force, pivoting portion 310 can move from the closed position to the open position under the urging force of mechanical urging mechanism 400. When pivoting portion 310 of display unit 300 is in the open position, a user can apply a pushing force to move pivoting portion 310 from the open position to the closed position. As pivoting portion 310 reaches the closed position, the first and second portions of the catch mechanism engage each other and hold pivoting portion 310 in the closed position when the user removes the pushing force.

As shown in the figures, mechanical urging mechanism 400 provides the opening force to pivoting portion 310 in lieu of using an electric motor or other electric or electronic device. Embodiments provide a quieter and smoother transition from the closed position to the open position than is provided by an electric motor or other electric or electronic device. In addition, no switch or button is needed with mechanical urging unit 400, whereas an electric motor or other electric or electronic device requires some sort of switch or button for activation. Embodiments provide a simpler and cleaner appearance to control panel 100 by avoiding the need for a switch or button. Also, because pivoting portion 310 is moved (and in the case of closing pivoting portion 310, the catch mechanism is released) by the user simply pushing on any part of display unit 300, the user does not need to locate and operate a small switch or button (as is the case with an electric motor or other electric or electronic device).

In the embodiment shown in the Figures, one mechanical urging mechanism 400 is provided in a central location of display unit 300. Other embodiments use two or more mechanical urging mechanisms.

Figure 18:
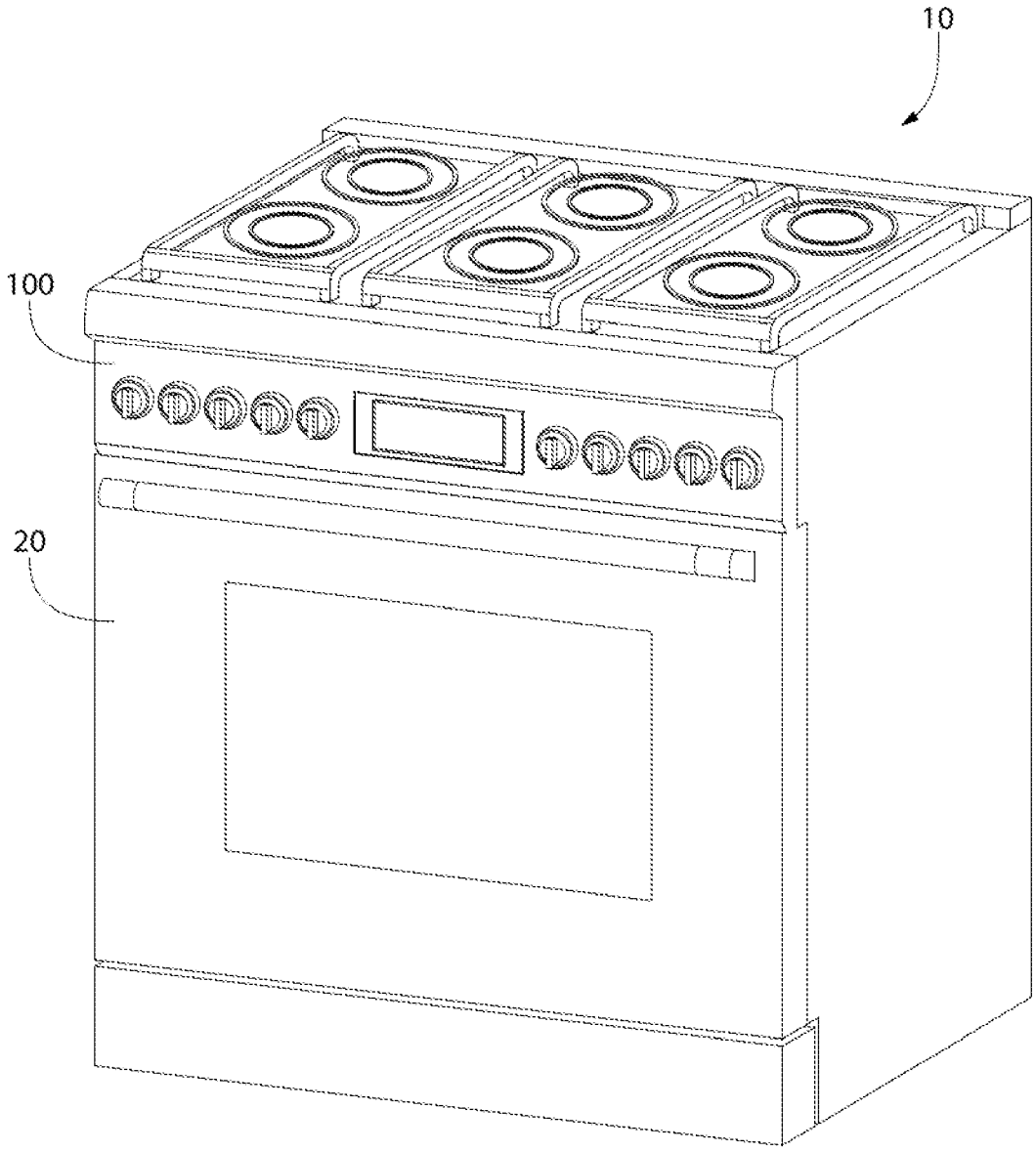
FIG. 18 is a perspective view of a domestic cooking appliance in accordance with embodiments of the invention.

FIG. 18 shows an example of an appliance 10 in accordance with embodiments of the invention. In this example, appliance 10 has a door 20 to a cooking chamber and a control panel such as control panel 100 as shown in FIGS. 1-17.

It will be appreciated that variants of the above-disclosed and other features and functions, or alternatives thereof, may be combined into many other different systems or applications. Any of the features described above can be combined with any other feature described above as long as the combined features are not mutually exclusive. Various presently unforeseen or unanticipated alternatives, modifications, variations or improvements therein may be subsequently made by those skilled in the art which are also intended to be encompassed by the invention.

What is claimed is:

1. A domestic cooking appliance for heating a food item, comprising:

a main housing;

a heating device that provides heat for heating the food item;

a control panel having controls that provide instructions to the heating device, the control panel having a front surface; and a display unit located in the control panel, the display unit having a stationary portion attached to the control panel, a pivoting portion pivotably attached to the stationary portion, the pivoting portion having a closed position and an open position, the pivoting portion having a front surface and a display that displays information to a user of the appliance, the front surface of the pivoting portion and the display being visible from an outside of the appliance in both the open position and the closed position, a pivoting mechanism located at an upper end of the pivoting portion and that attaches the pivoting portion to the stationary portion such that the pivoting portion pivots relative to the stationary portion about the pivoting mechanism, a mechanical urging member that urges the pivoting portion in a direction from the closed position to the open position via an urging force conveyed through at least one arm attached to a lower end of the pivoting portion, and a holding mechanism that retains the pivoting portion in the closed position, wherein the front surface of the pivoting portion is in a plane parallel to the front surface of the control panel when the pivoting portion is in the closed position, and a lower end of the front surface of the pivoting portion is positioned away from the front surface of the control panel when the pivoting portion is in the open position.

2. The domestic cooking appliance of claim 1, wherein the holding mechanism is disengaged by pressing, while the pivoting portion is in the closed position, the front surface of the pivoting portion in a direction of the appliance and beyond the closed position.

3. The domestic cooking appliance of claim 2, wherein the holding mechanism is engaged by pressing, while the pivoting portion is in the open position, the front surface of the pivoting portion in the direction of the appliance and to the closed position.

4. The domestic cooking appliance of claim 1, wherein the mechanical urging member is a cylinder and piston mechanism containing a gas.

5. The domestic cooking appliance of claim 4, wherein an end of the cylinder and piston mechanism is pivotably attached to the stationary portion.

6. The domestic cooking appliance of claim 5, wherein the cylinder and piston mechanism is the sole urging member, and the cylinder and piston mechanism is located centrally in a transverse direction of the control panel.

7. The domestic cooking appliance of claim 1, wherein the mechanical urging member is a spring.

8. The domestic cooking appliance of claim 7, further comprising a damper that opposes motion of the pivoting portion between the closed position and the open position.

9. The domestic cooking appliance of claim 1, wherein the pivoting mechanism is a pin attaching the pivoting portion to the stationary portion.

10. The domestic cooking appliance of claim 1, wherein the front surface of the pivoting portion is in a first plane, a front surface of the display is in a second plane, and the first plane is parallel to the second plane.

11. A control panel for a domestic appliance, the control panel having a main body, the main body having a front surface;

controls attached to the main body that provide instructions to devices of the domestic appliance; and a display unit located in the main body, the display unit having a stationary portion attached to the main body, a pivoting portion pivotably attached to the stationary portion, the pivoting portion having a closed position and an open position, the pivoting portion having a front surface and a display that displays information to a user of the appliance, the front surface of the pivoting portion and the display being visible from an outside of the control panel in both the open position and the closed position, a pivoting mechanism located at an upper end of the pivoting portion and that attaches the pivoting portion to the stationary portion such that the pivoting portion pivots relative to the stationary portion about the pivoting mechanism, a mechanical urging member that urges the pivoting portion in a direction from the closed position to the open position via an urging force conveyed through at least one arm attached to a lower end of the pivoting portion, and a holding mechanism that retains the pivoting portion in the closed position, wherein the front surface of the pivoting portion is in a plane parallel to the front surface of the main body when the pivoting portion is in the closed position, and a lower end of the front surface of the pivoting portion is positioned away from the front surface of the main body when the pivoting portion is in the open position.

12. The control panel of claim 11, wherein the holding mechanism is disengaged by pressing, while the pivoting portion is in the closed position, the front surface of the pivoting portion in a direction of the main body and beyond the closed position.

13. The control panel of claim 12, wherein the holding mechanism is engaged by pressing, while the pivoting portion is in the open position, the front surface of the pivoting portion in the direction of the main body and to the closed position.

14. The control panel of claim 11, wherein the mechanical urging member is a cylinder and piston mechanism containing a gas.

15. The control panel of claim 14, wherein an end of the cylinder and piston mechanism is pivotably attached to the stationary portion.

16. The control panel of claim 15, wherein the cylinder and piston mechanism is the sole urging member, and the cylinder and piston mechanism is located centrally in a transverse direction of the control panel.

17. The control panel of claim 11, wherein the mechanical urging member is a spring.

18. The control panel of claim 17, further comprising a damper that opposes motion of the pivoting portion between the closed position and the open position.

19. The control panel of claim 11, wherein the pivoting mechanism is a pin attaching the pivoting portion to the stationary portion.

20. The control panel of claim 11, wherein the front surface of the pivoting portion is in a first plane, a front surface of the display is in a second plane, and the first plane is parallel to the second plane.

* * * * *